US012663169B2

(12) United States Patent
Siegenthaler

(10) Patent No.: US 12,663,169 B2
(45) Date of Patent: Jun. 23, 2026

(54) HEAT EXCHANGE SYSTEM FOR THE THERMAL REGULATION OF A BUILDING

(71) Applicant: Andy Siegenthaler, Yverdon-les-Bains (CH)

(72) Inventor: Andy Siegenthaler, Yverdon-les-Bains (CH)

( * ) Notice: Subject to any disclaimer, the term of this patent is extended or adjusted under 35 U.S.C. 154(b) by 552 days.

(21) Appl. No.: 17/801,245

(22) PCT Filed: Feb. 16, 2021

(86) PCT No.: PCT/IB2021/051286

§ 371 (c)(1),
(2) Date: Aug. 20, 2022

(87) PCT Pub. No.: WO2021/165824

PCT Pub. Date: Aug. 26, 2021

(65) Prior Publication Data

US 2023/0079347 A1 Mar. 16, 2023

(30) Foreign Application Priority Data

Feb. 20, 2020 (CH) ..... 198/20

(51) Int. Cl.
*F24F 1/14* (2011.01)
*F24F 11/83* (2018.01)

(52) U.S. Cl.
CPC ..... *F24F 1/14* (2013.01); *F24F 11/83* (2018.01)

(58) Field of Classification Search
CPC .. F24F 1/14; F24F 11/83; Y02B 10/20; Y02B 10/70; Y02B 10/40; Y02B 30/12; Y02E 10/40; Y02E 10/10; E04D 11/00; F24D 3/18; F24D 17/02; F24D 11/02; F24S 20/40; F28D 5/00
See application file for complete search history.

(56) References Cited

U.S. PATENT DOCUMENTS 5,287,650 A * 2/1994 Moriguchi ..... E04D 11/002 47/59 R
2002/0164447 A1 11/2002 Asgian
2007/0199341 A1 8/2007 Hart
2012/0260572 A1* 10/2012 Behrens ..... A01G 20/20 47/65.9

(Continued)

FOREIGN PATENT DOCUMENTS

EP 0053746 A2 6/1982
ES 2186455 A1 5/2003

(Continued)

OTHER PUBLICATIONS

International Search Report for PCT/IB2021/051286, dated Apr. 1, 2021, 3 pages.

(Continued)

*Primary Examiner* — Lionel Nouketcha
(74) *Attorney, Agent, or Firm* — BLANK ROME LLP

(57) ABSTRACT

Heat exchange system on a roof of a building, with an exchange volume comprising a substrate that is partly saturated by water and covered by a vegetated surface that enhances condensation and evapotranspiration and having a heat diffusion device comprising a circulation pump and a collection network for thermal exchanges with the exchange volume.

19 Claims, 4 Drawing Sheets

(56) References Cited

U.S. PATENT DOCUMENTS

2019/0254244 A1* 8/2019 Brion ..... A01G 31/02

FOREIGN PATENT DOCUMENTS

| | | | | | |
|---|---|---|---|---|---|
| GB | 2516260 | A | * | 1/2015 | ..... F24S 10/755 |
| JP | 2001056197 | A | | 2/2001 | |
| JP | 2002130740 | A | | 5/2002 | |
| JP | 2003-083656 | A | | 3/2003 | |
| JP | 2003105883 | A | | 4/2003 | |
| JP | 2013507975 | A | | 3/2013 | |
| KR | 10-2010-0137358 | A | | 12/2010 | |
| WO | WO-2011/117437 | A1 | | 9/2011 | |

OTHER PUBLICATIONS

Thomson Scientific, London, GB; vol. 2003, No. 49, AN 2003-515607, Section PQ, Retrieved from: Database WPI [online] XPOO2799477, 1 page.

Office Action for Korean Application No. 10-2022-7032018, mailed Jul. 19, 2024, 9 pages, with English language translation.

* cited by examiner

HEAT EXCHANGE SYSTEM FOR THE THERMAL REGULATION OF A BUILDING

REFERENCE DATA

The present application is a national phase of International patent application PCT/IB2021/051286 of Feb. 16, 2021 claiming priority from Swiss patent application 00198/20 of Feb. 20, 2020, the contents whereof are hereby incorporated entirely.

TECHNICAL FIELD

The present invention relates to a heat exchange system which enables the temperature inside a building to be regulated. The heat exchange system uses in particular the inputs and the discharges of heat resulting from the condensation and evaporation of water. Embodiments relate, among other possible embodiments, to a vegetated roof for a building which integrates a heat exchange circuit. The invention may be used in installations which operate in monovalent mode, that is, only with renewable energy, or in conjunction with a conventional thermal installation in bivalent mode. It enables the interior of the building to be heated, cooled and enables the heating and cooling modes to be combined.

PRIOR ART

Heat pump heating systems (HP) enable thermal energy to be transferred from a medium at low temperature to a medium at high temperature. Heat pumps are increasingly used for heating buildings and for the production of hot water as a result of their greater energy efficiency. For the operation thereof, the heat pump is dependent on a cold source which may be a geothermal probe, or simply the atmosphere, inter alia.

Geothermal systems, such as vertical probes and planar catchment, are known in order to enable the internal temperature of buildings to be regulated by circulating a heat-exchange fluid in the subsoil. Vertical probe systems substantially use the thermal inertia of the deep layers of the subsoil sometimes at a depth of several hundreds of meters, which enables the residual energy to be drawn therefrom during external temperature variations and they are often used as a cold source for heating systems with a heat pump. However, they have the disadvantage of a limited service-life, particularly as a result of the heat exchanges which tend to decrease the energy which can be recovered over time, in particular as a result of a geothermal energy input which is too low to keep the temperature at the source constant. Geothermal installations with planar catchment further require the heat-transfer fluid circuits to be buried at depths which are sufficient to prevent seasonal temperature variations, and in particular freezing. Depths for burying are generally one meter or more, which requires not insignificant installation efforts. Furthermore, the use of geothermal systems requires extensive and free zones, which may be found to be difficult, or even impossible in an urban zone, owing to lack of space and subsoils which are congested with pipes or water tables. This results in conventional heating systems being retained, sometimes in spite of their high cost of use and their harm with respect to the environment.

When geothermal thermal sources are not available, heat pumps may use the atmosphere as a cold source, via a heat exchanger. These aerothermal solutions are relatively widespread in regions with a temperate climate, but their energy performance levels are lower and are further reduced when the external temperatures decrease. Furthermore, the aerothermal heat exchange requires costly and noisy forced ventilation which limits the energy performance level and the use thereof in an urban environment.

There are also known installations in which the thermal energy captured by solar collectors is stored in large hot water tanks when the direct sunlight is sufficient, and which are used to heat a building or to produce hot water, most often by means of a heat pump which uses the tank as a cold source. However, these solutions require significant thermally insulated storage tanks which are costly and cumbersome. The solar collectors are also interdependent on the external temperatures and do not directly enable cooling in the summer.

There is therefore scope to develop heat exchange systems which are simple, energy-efficient and enable heat to be recovered in a renewable manner, whilst respecting the environment and being particularly suitable for urban regions, and all regions in which the installation of other energy-efficient systems is impossible.

BRIEF SUMMARY OF THE INVENTION

The present invention proposes a heat exchange system which limits the disadvantages set out above.

In particular, the heat exchange system according to the present invention comprises an exchange volume which is arranged on an approximately horizontal external surface which is superimposed on or adjacent to the building, for example, on a roof of the building, a heat diffusion device which comprises at least one collection network which is integrated in the exchange volume, for example, a hydraulic circuit, in which glycol water or another appropriate fluid is circulated, in order to capture the heat of the heat exchange system. Significantly, the exchange volume comprises a substrate having a porous and/or mesoporous and/or microporous texture which enables water to be retained on the external surface thereof in contact with the atmosphere, and a vegetated layer which is covered by plants of the muscoid type.

The terms "micropore" and "microporous" and "mesopore" and "mesoporous" refer to cavities whose size is sufficiently small to prevent the circulation of water by means of gravitational force or convective movements but which is still sufficient for the plants to be able to benefit from the water contained therein. Numerically, it is possible to consider that the micropores have a size between 5 μm and 30 μm, whilst the sizes of mesopores are between 30 μm and 75 μm, but these numerical limits are not precise. The "macropores", whose size is approximately greater than 75 μm, are too large to bring about significant capillary forces and have a very limited water retention capacity.

The advantage of vegetation of the muscoid type originates from its very significant and active total exchange surface. Heat exchanges with the environment mainly result from the condensation/evaporation of water (and to a lesser extent than solidification/liquefaction and sublimation/gasification). This enables very significant inputs of latent energy during winter and losses by means of evapotranspiration in summer. These latent inputs, together with the inputs of solar energy (direct and indirect radiation) and sensible inputs (air, precipitation and building), and a sufficiently large storage of energy in a moist substrate, enable the recovery to be made efficient.

In contrast to deeper planar garden catchments, the system of the invention is located much closer to the surface of the substrate and can thus benefit from other inputs, such as sunlight and conduction of sensible energy (air, precipitation and building) which enable the system to be recharged in a nychthemeral cycle. In contrast to solar thermal collectors, the system enables better recovery of indirect solar radiation during overcast days. In summer, the increased temperatures of the air and the surface enable evaporation which is accompanied by an increased transpiration of the plants, which advantageously, in the case of muscoid plants, do not have stomas to control their water loss.

Preferably, the substrate of the catchment system of the invention is at least partially saturated with water and comprises a non-saturated portion and a saturated portion which is subjacent to the non-saturated portion. By keeping a portion of the substrate constantly saturated with water, the heat storage capacity is improved without excessive loss of heat by means of convection. This is because the porous nature of the substrate prevents the transfer of thermal energy brought about by water convection movements. This substrate therefore enables a storage which is decoupled from the heat requirements and enables energy recovery of the water/water type, which is associated with greater efficiency levels than the ground/water and air/water type. It is preferable to use an organic substrate (natural or synthetic) which has a low level of thermal conductivity and which is light (preferably having a saturated weight <900 kg/m$^3$) and imperishable.

The catchment system is preferably connected to a circulation pump and/or a heat pump which enables efficient collection of the energy stored. A variant of the invention can also operate in a "free-cooling" mode in which the fluid contained in the catchment system is used (directly or by means of a heat exchanger) in order to cool the building without passing via the heat pump.

Preferably, the invention comprises one or more sensors which enable one or more environmental parameters, such as temperature, humidity, etcetera, to be determined and a control unit which enables the data collected to be processed and enables the operation of the heat exchange system to be controlled.

In order to be able to withstand unfavourable weather conditions, for example, low temperatures or significant precipitation, the system of the invention is configured not to place unfavourable stress on the structure of the building in the event of freezing. This can be carried out inter alia by means of one or more damping zones which comprise deformable elements which can absorb the expansion of the ice without transmitting this to the structure of the building. For greater safety, the system may be provided with an overflow in order to discharge surplus water, and the exchange volume may be surrounded by a parapet which is arranged on the periphery of the exchange volume and whose height exceeds that of the exchange volume in order to contain it, and which is fixed to the building from the external periphery thereof in order to be able to be readily replaced or repaired.

The vegetated layer is advantageously of the muscoid type. It includes in particular plant species such as mosses, lichens and other associated species. The muscoid layer includes varieties or plant species of the non-muscoid type which are known to be often present with muscoid varieties or which live alongside them in order to comply with a stable and perennial ecosystem. The vegetated layer is selected in order to promote the evaporation of water, in particular as a result of the transpiration of the plant species which are used. A muscoid vegetated layer is particularly suitable for the evaporation as a result of the absence of stomas which characterizes such species. On the other hand, such a layer is composed of an infinite number of foliar branches which represents a very large total condensation surface. Another advantage of these plant species is the absence of a root system which could disturb the thermal gradients in the exchange volume and create undesirable thermal bridges between the surface and the deep layers. This absence of roots also enables the sealing layer of the building to be better preserved. The muscoid plants have excellent resistance to drying and freezing, and a more advantageous albedo than coatings of bitumen or gravel.

The relative height of the saturated portions and non-saturated portions of the substrate is dependent on the requirements of evaporation speed, duration of thermal regulation or other factors. In particular, it is significant that the humidity gradient in the upper portion of the substrate can be kept relatively constant, whilst maintaining sufficient humidity in the vegetated layer to keep it active.

Given the light nature and the reduced height of the substrate, the collection circuits are preferably secured to a resilient structure in order to be able to control the conduction and the thermal expansion. This structure may be produced by a planar flexible framework which is placed on a layer of felt which is resistant to occurrences of torsion, shearing and perforation. This protection felt of at least 5 mm has the dual function of retaining the water and protecting the subjacent sealing layers. The conditions in the saturated zone of the substrate are: humidity level close to saturation, reduced concentration of oxygen and acidic/basic pH. The framework is preferably made from materials which are capable of tolerating this environment. Several plastics materials and some wood or bamboo species can be used for this application. However, the majority of metals used in the field of construction may release elements which are toxic to muscoid plants.

The present invention is particularly suitable for urban arrangements, facilitating the use of economic and ecological devices. In addition to the thermal regulation of a building, the invention also enables low vegetation which costs little to maintain and which can be combined with the installation of other renewable energy recovery devices such as photovoltaic panels or thermal collectors. The present invention also enables ecological services to be ensured, such as: the sequestration of atmospheric $CO_2$, ecological diversification, the retention and reduction of the flow of water, thermal and noise protection, micro-climatic regulation and environmental appearance.

BRIEF DESCRIPTION OF THE FIGURES

Embodiments of the invention are set out in the description illustrated by the appended Figures, in which.

EMBODIMENT(S) OF THE INVENTION

Figure 1A:
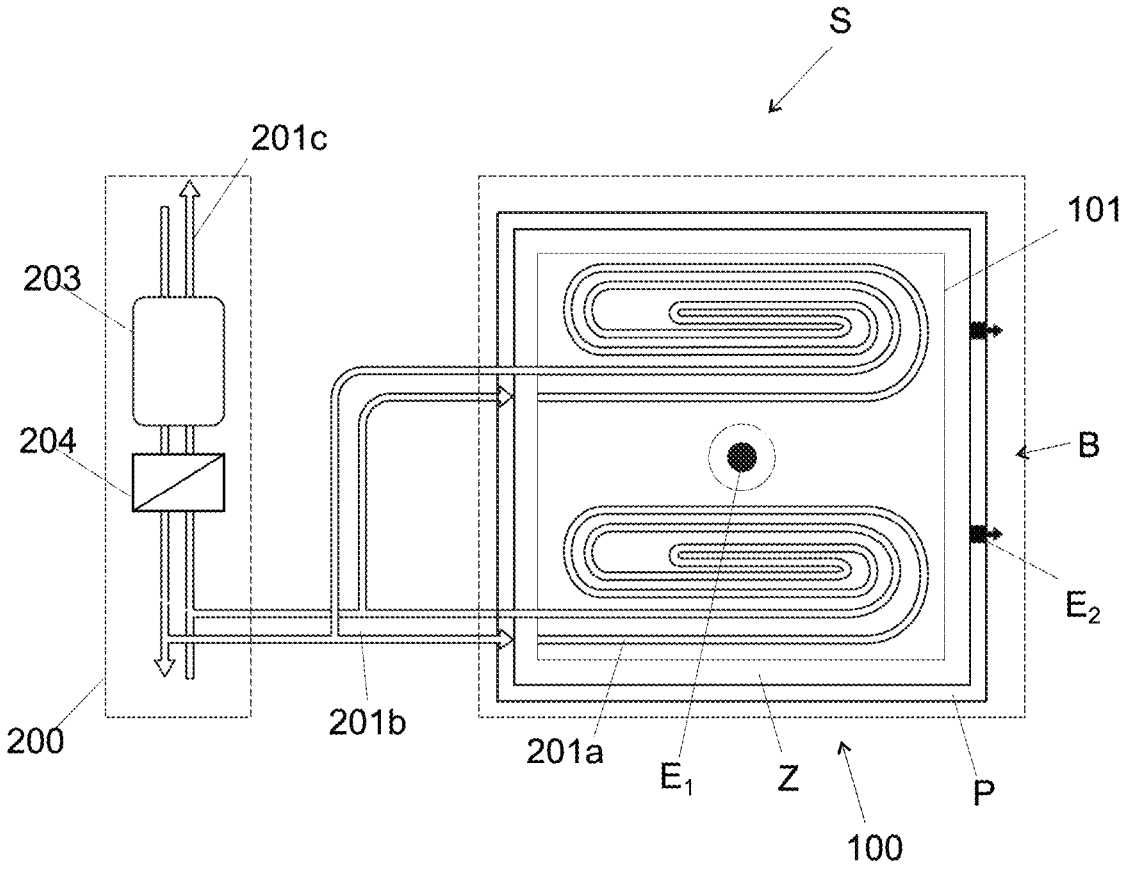
FIG. 1*a*: shows a schematic plan view of a thermal regulation system according to the invention.
Figure 1B:
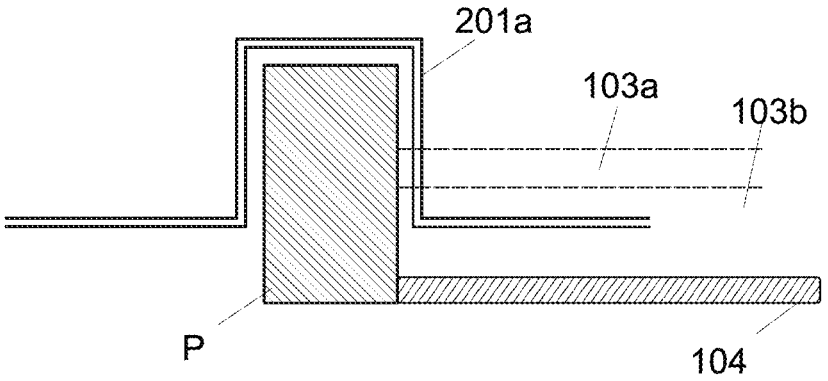
FIG. 1*b*: shows a lateral schematic section of the connection of the collection pipes to the external network.
Figure 2:
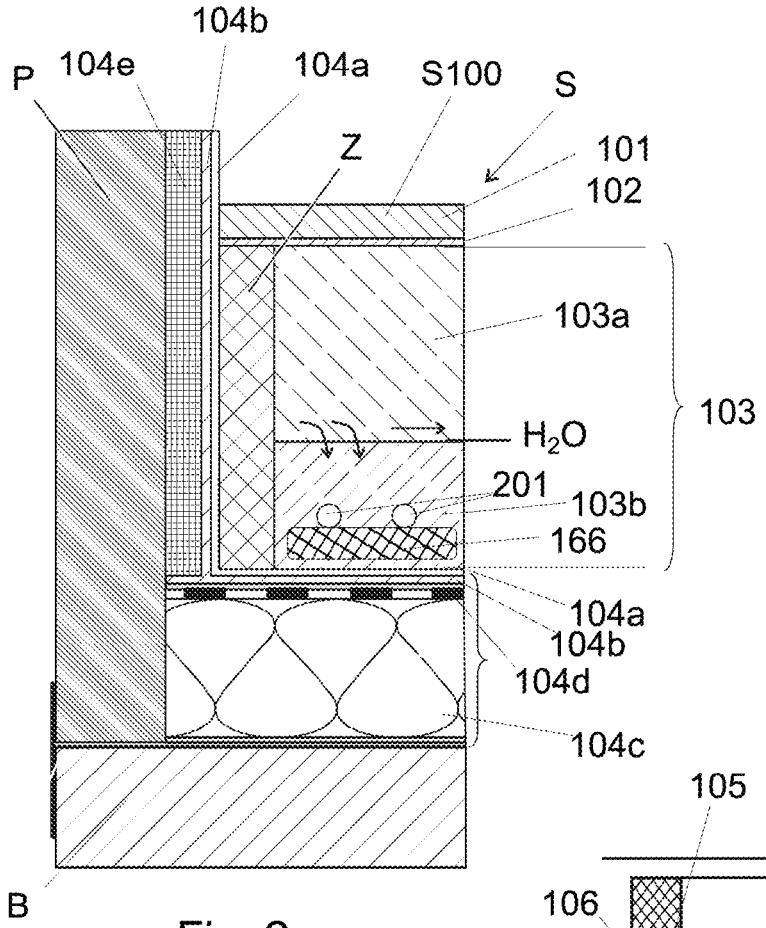
FIG. 2: shows a schematic sectioned view of a thermal regulation system according to the invention.

With reference to FIGS. 1*a*, 1*b* and 2, the heat exchange system S according to the present invention comprises an exchange volume 100 which is arranged on the upper portion or adjacent portion of a building B. The upper or adjacent portion of a building is intended to be understood to be any approximately horizontal surface which is in contact with free air, it includes the roof, a terrace or any other portion which covers a surface of the building B. The building B includes residential buildings, comprising one or more storeys, such as 2, 3, 4, 5 storeys or more, businesses, workshops, garages, warehouses and any other construction which requires thermal regulation.

The exchange volume 100 comprises an external surface S100 which is in contact with the free air and which enables the exchanges with the atmosphere to be modulated. The exchanges with the atmosphere include, for example, receiving direct and indirect sunlight, the condensation and evaporation of atmospheric water, thermal diffusion, the collection of rainwater, the evaporation of humidity present in the exchange volume 100 and in particular the evapotranspiration of the humidity by the active surfaces of the vegetation.

The exchange volume 100 comprises, below the external surface S100, a substrate 103 enabling energy to be stored. The substrate 103 comprises to this end macroporous (structural), mesoporous and/or microporous (textural) elements which enable the majority of the water to be retained and the circulation by means of convection to be limited, whilst enabling a degree of drainage. It may, for example, contain lignin, pozzolana, expanded clay, aluminosilicates (for example, zeolite, perlite) or any other light material having a mesoporous and/or microporous texture which enables humidity to be retained. It is important for the substrate 103 to be sufficiently light not to compromise the stability of the structure of the building B. Furthermore, these porous materials are composed of elements having a low thermal conductivity compared with the water which they contain, and they limit the thermal exchanges by means of convection by retaining the water in their pores. The physical properties of the substrate 103 enable a significant temperature gradient between the external surface S100 and the surface of the building B so that, during winter, the lower portion of the substrate 103 is normally frost-free in a temperate climate.

Mineral materials such as earth, clay or gravel are for this purpose too heavy to be able to be used on such structures. It is also important that the substrate 103 is imperishable in order to be maintained over time. Completely natural materials, composite materials or synthetic materials may be used and the mixture of such materials. The substrate 103 may be uniform or composed of a plurality of superimposed layers of different materials. The material used should not change the subjacent sealing layers chemically or physically.

The water which is retained in the porosity of the substrate 103 acts as an energy store, in particular as a result of its high thermal capacity. This store acts as a source or as a pit of heat in accordance with the season or the thermal cycle in question. When the maximum water capacities of the substrate 103 are reached, the water remains in free form in the lower portion of the exchange volume 100. The portion of the substrate 103 thereby immersed corresponds to the portion 103*b* saturated with water. The portion of the substrate 103 which is not immersed in the residual water corresponds to the non-saturated portion 103*a*. The non-saturated portion is involved in the modulation of the exchanges with the atmosphere, in particular as a result of its capillary action which enables the migration of water from the saturated portion 103*b* to the external surface S100. Preferably, the substrate 103 is determined so as to keep constant, or approximately constant, the humidity gradient between the external surface S100 and the saturated portion 103*b*, particularly when water is evaporated via the external surface S100. Advantageously, the humidity gradient is maintained regardless of the quantity of water present in the saturated portion 103*b* until it is completely dried. The height of the substrate and external surface S100 is sized so that, when the volume 100 is saturated, the maximum weight load determined by the structure of the building is not exceeded.

The height of the saturated portion 103*b* may be limited using one or more flow devices E1, E2 which are provided in the heat exchange system S. The maximum height may be predetermined in accordance with meteorological parameters specific to the location, such as the frequency and quantity of precipitation, the quantity of condensation or evaporation, and any other relevant parameter, the objective being to maintain a sufficient reserve of energy as a result of the saturated portion 103*b*. If natural inputs of water would be insufficient, there may provision for a water inlet which can be activated in order to preserve the saturated portion 103*b*.

Figure 3:
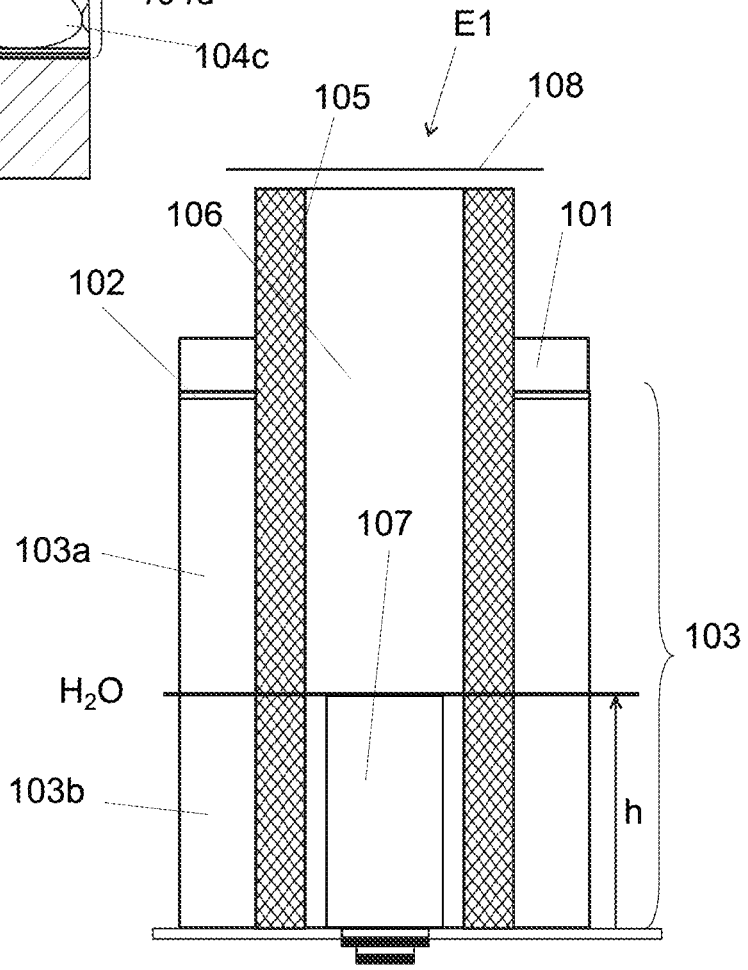
FIG. 3: shows a detailed section of a water discharge according to an embodiment of the invention.

One or more vertical flow devices E1, which are arranged in the substrate 103, may be additionally or alternatively provided. According to one embodiment illustrated in FIG. 3, the vertical flow device E1 is a sieve 105 which is permeable to water and which resists lateral pressures of the volume 100. The sieve 105 has a hollow form, which is, for example, cylindrical and which encloses a free space 106 at the inner side thereof. The sieve 105 may be in the form of a fine grid, or a porous material or any other device which has filtering properties in order to allow only water to pass and to keep the rest of the elements of the exchange volume 100 on the roof of the building B. The space 106 is in hydrostatic balance with the water which is retained in the substrate 103. A pipe 107 enables water to flow as soon as the level exceeds the height "h" of the upper edge thereof. The cylindrical sieve 105 may be surmounted by a protection plate 108. If required, the height of the upper edge of the vertical pipe may be controlled manually, or automatically by means of a control unit 300, in accordance with environmental parameters.

One or more safety flow devices E2, which are arranged on the periphery of the exchange volume 100, may be used in order to discharge the overflow of water, in the event of extreme wet weather events, thus enabling the maximum weight load not to be exceeded.

The heat exchange system S further comprises a segregation device 104 which enables the building B to be thermally insulated from the substrate 103. The segregation device 104 is in particular sealed with respect to water and humidity. It may comprise one or more single layers or one or more multilayers. The segregation device 104 comprises, in the example illustrated, one or more sealed coating layers 104*b*, such as the coatings which are commonly used for sealing buildings. The sealed coating 104*b* may be manufactured based on tarred materials, or impermeable plastics material or other equivalent materials, either alone or in combination. The selection of the material is made taking into consideration the acidity conditions present in the saturated zone 103*b* of the substrate. The sealed coating 104*b* may comprise several layers of the same material or different materials. The thickness of the sealed coating is in the order of from 1 to 10 millimetres, typically between 2 and 6 mm.

The sealed coating 104 is advantageously protected by a protection layer 104*a*. The protection layer 104*a* protects the sealed coating 104*b* from any impacts or damage caused by the substrate 103. This protection layer is particularly useful when angular elements are present in the substrate 103. The protection layer 104*a* may be in the form of a protection felt which is preferably non-biodegradable. The protection layer 104*a* may alternatively comprise a flexible, semi-rigid or rigid material, or a combination of such materials. Such a combination may also include prefabricated water drainage and storage plates which are placed on a flexible layer. The thickness of the protection layer 104*a* is in the order of from 1 mm to 10 cm, in particular in the order of from 3 to 6 mm.

The segregation device 104 is preferably provided with a horizontal thermally insulating layer 104*c*. Any insulating material which is known and generally used may act as a horizontal insulating layer 104*c*. The horizontal insulating layer 104*c* may, for example, be a layer of expanded polystyrene, or panels of rock wool or glass wool, or cellular concrete. The horizontal insulating layer 104*c* is arranged below the sealed coating 104*b* in order to remain protected from moisture. A subjacent vapor barrier layer 104*d* may be arranged on the surface of the roof of the building B. A superficial vapor barrier layer 104*d* may additionally or alternatively be arranged on the external surface of the horizontal insulating layer 104*c*, in accordance with usual practice. Each vapor-barrier layer has a thickness in the order of a few millimetres, typically from 1 to 5 mm. The thickness of the horizontal insulating layer 104*c* is variable in accordance with the insulating objectives intended.

The thermal exchanges between the inside of the building B and the heat exchange systems S are carried out using a thermal diffusion device 200, comprising one or more pumps and one or more pipe networks 201 and, preferably, a heat exchanger for free-cooling operation 204. In particular, the thermal diffusion device 200 comprises one or more collection networks 201*a* which are arranged in the substrate 103 in order to circulate a heat-transfer fluid through the exchange volume 100. The pipes of the collection network 201*a* may be arranged in helical form, sinuously, in parallel lines over the entire exchange surface 100, in accordance with a mesh network, in a circular arrangement, or in accordance with any other arrangement which is deemed to be appropriate by the person skilled in the art. The collection network 201*a* may include, in place of the tubular pipes which are illustrated or in combination therewith, planar heat-transfer fluid circulation systems, for example, constituted by heat exchange systems inside which it is possible to establish a complete circulation of heat-transfer fluid.

A plurality of collection networks 201*a* may be connected in parallel with each other by means of a heat distributor. It should be noted that the maximum catchment density of the exchange system S, in meters of pipe per square meters of surface, may be higher than in a planar garden catchment system. The density and the number of collection pipes and/or heat exchange plates 201*a* must be adapted to the requirements and the heating or cooling method (monovalent, with a single energy source, or bivalent, with several sources of energy). The collection pipes and/orthe heat exchange plates 201*a* arranged in the exchange volume are preferably flexible or semi-rigid. They are more specifically arranged in the saturated portion 103*b* and are secured to a flexible framework 166 which is placed flat on the protection layer 104*a*. The collection network 201*a* preferably forms a closed circuit, which is thermally connected to the internal network 201*c*, which enables another heat-transfer fluid to be circulated inside the building B. The thermal connection between the collection network 201*a* and the internal network 201*c* may, for example, be carried out by means of an external network 201*b*.

The fluid circulating in the circulation pipes 201 may be water, optionally with antifreeze added, such as ethylene glycol, anti-corrosion components or fungicides or bactericides, or a mixture of such components. Alternatively, the fluid may be another heat-transfer liquid, or coolant, which is generally used in cooling or heating systems. The heat-transfer fluid which circulates in the network of internal pipes 201*c* is preferably water.

Figure 4A:
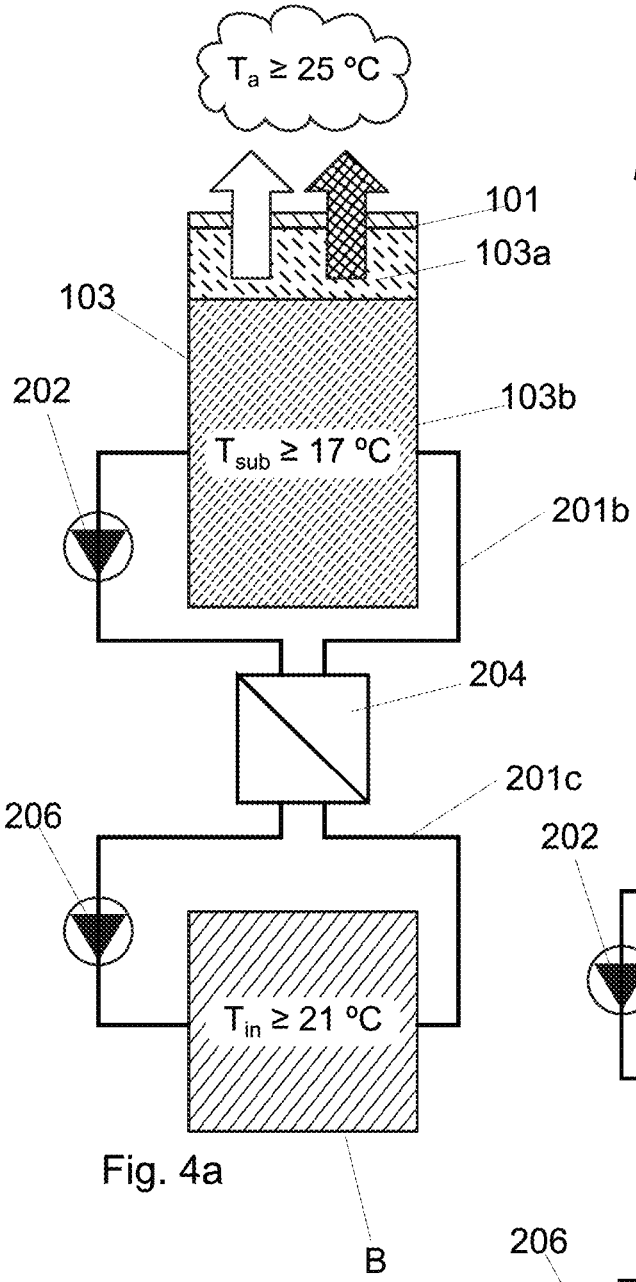
FIGS. 4*a* and 4*b*: show an operating diagram of the invention according to an embodiment with free-cooling, with a heat pump for heating and/or the production of domestic hot water, respectively.
Figure 4B:
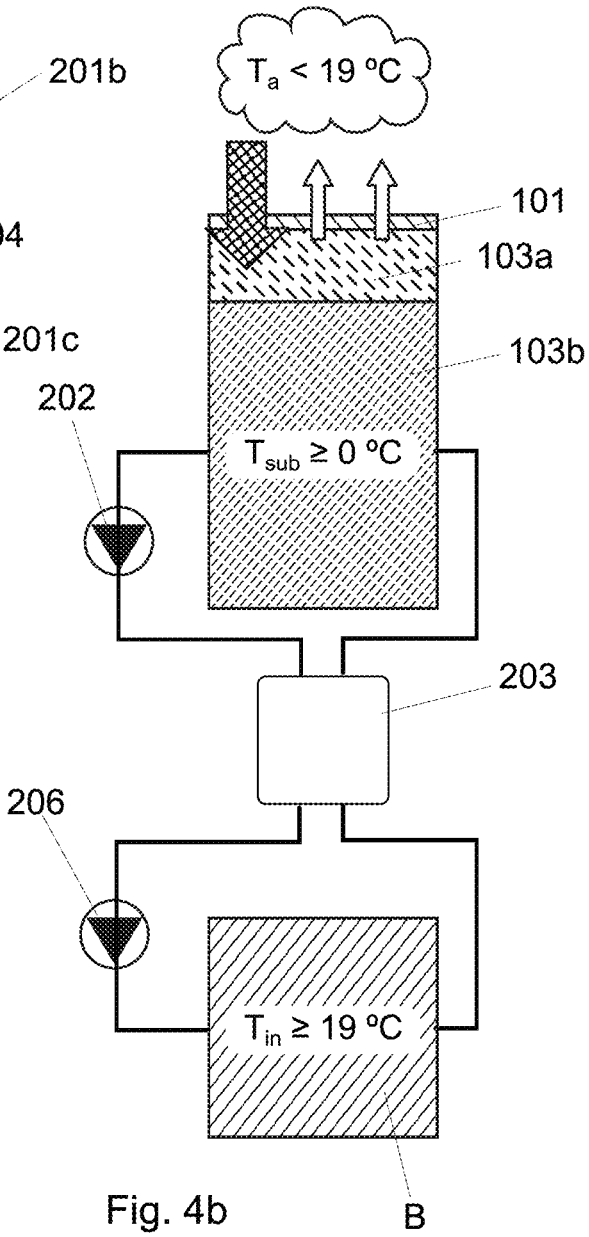

The thermal diffusion device 200 of the invention may comprise a heat pump 203 for operating in heating mode or producing domestic hot water, and/or a heat exchanger 204 for operating in the "free cooling" cooling mode. FIGS. 4*a* and 4*b* illustrate these operating configurations. The switching between these two operating modes is preferably carried out by means of an assembly of automatic three-way valves which are not illustrated.

The internal pipes 201*c* may be arranged in a thermosyphon, thus promoting a free circulation of fluid. It may be advantageous to include an accelerator or a circulation pump 206 which enables the fluid circulation to be activated. The circulation of the heat-transfer fluid in the external circuit 201*b* is preferably ensured by means of a circulation pump 202.

The "free-cooling" operating mode illustrated in FIG. 4*a* is preferably activated when the external temperature $T_a$ is higher than a predetermined threshold, for example, 25° C. Under these conditions, the humidity of the substrate 103 evaporates. Furthermore, the layer of muscoid vegetation 101, which does not have stomas, transpires extensively and acts as an inverted heat pump. As a result of the latent heat loss resulting from this process of bioactive evapotranspiration, the temperature of the substrate $T_{sub}$ may be between 6 and 9° C. lower than the air temperature $T_a$, which is sufficient to cool the building, via the plate-type heat exchanger 204.

In the heating operating mode illustrated in FIG. 4*b*, the mosses of the vegetated layer 101 act as an efficient core for condensation/freezing/sublimation for the recovery of inputs of latent energy. The rain, air and the external structure of the building are other non-negligible sources of sensible heat. During winter, the evapotranspiration is too low to counteract the inputs.

The organic substrate 103*b* which is saturated with water enables heat to be stored in a nictemeral cycle (day/night) and allows collection temperatures which are out of phase with the temperature of the external air, resulting in performance levels which are significantly greater than an aerothermal air/water system. The heat losses resulting from convective movements are limited by the porosity of the substrate 103. The heat recovery pipes and/or the heat exchange plates which are placed between 18 and 50 cm below the surface do not freeze in principle under temperate climatic conditions. However, it is possible to provide anti-freezing safety measures in mountainous or continental climates (typically with a negative mean air temperature for the coldest month) and an adaptation of the pressure and temperature conditions in the evaporator of the compression/expansion circuit of the heat pump 203.

It should be noted that the heating operating mode is active in winter and also in an intermittent manner in summer for the production of domestic hot water. During the months of summer, the heat pump 203, by drawing the heat from the substrate 103*b*, will contribute to lowering the temperature $T_{sub}$ and maximizes the efficiency of the free-cooling cooling system of FIG. 4*a*. The high temperature of the substrate in summer enables domestic hot water to be heated with an efficiency greater than a ground/water system with a vertical geothermal probe.

According to a specific embodiment, the circulation pumps 202, 206, the heat pump 203 and the valves which are required for switching between cooling and heating may be connected to one or more thermal probes in order to be activated automatically if required, particularly when the temperatures of the exchange volume 100 and/or the interior of the building B are considered to be suitable for a heat exchange. The activation of the heat pump and the circulation pumps may be subjected to temperature measurements so that the temperature is regulated in an automatic manner.

According to another embodiment, the internal pipes 201*c* or external pipes 201*b* are connected or integrated in a conventional heating or cooling circuit. They may be connected to one or more valves which enable them to be placed in relation to a pre-existing circuit or isolated from such a circuit. A pre-existing circuit may, for example, be a geothermal circuit which it is necessary to supplement with the heat exchange system to which the present invention relates, or a conventional central heating installation, or a solar collector installation. The heat pump may then be placed in relation in a bivalent mode to one or more other thermal networks using one or more 3-way or 4-way valves.

Figure 5:
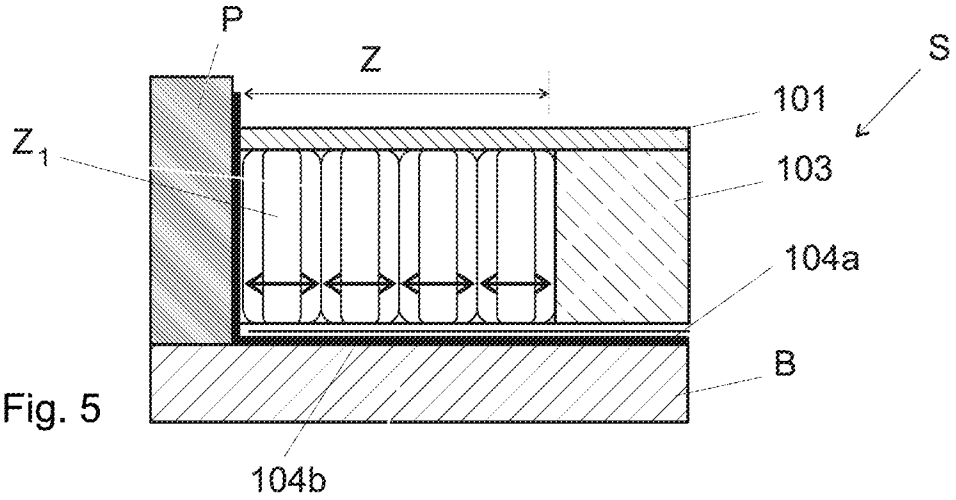
FIG. 5: shows a schematic sectioned view of a damping zone of the present invention.
Figure 6:
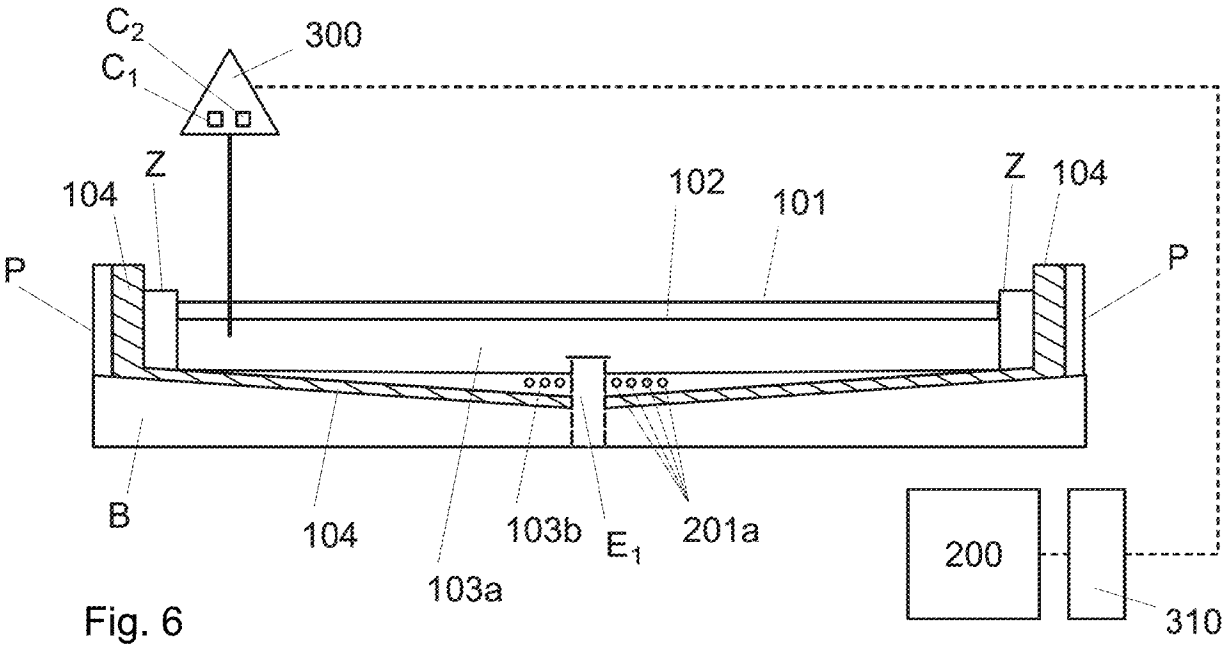
FIG. 6: shows a lateral sectioned view of the thermal and water regulation system according to the invention.

With reference now to FIGS. 2, 5 and 6, the exchange volume 100 advantageously comprises one or more damping zones Z which are intended to absorb any volume variations of the substrate 103 which result in particular from the temperature or hygrometry variations or freezing in climates with a mean negative temperature for the coldest month. The damping zone(s) Z may, for example, extend over the entire periphery of the exchange volume 100 or over a portion of this periphery. Alternatively or additionally, one or more damping zones Z may be arranged in the exchange volume 100, for example, in the form of transverse lines which are spaced apart from each other by a predetermined distance, or in the form of islands.

The damping zone(s) Z comprise(s) resiliently deformable elements Z1 which are juxtaposed relative to each other. Such resiliently deformable elements Z1 may comprise, for example, synthetic foams with closed cells which are non-biodegradable, such as neoprene foams, nitrile butadiene or vinyl ethylene acetate. Polyurethane is preferably not used as a result of the risks of reaction with the acidity of the substrate 103. The deformable elements Z1 may comprise hollow cylinders, whose internal diameter corresponds to a third or a half to two thirds of the external diameter. Preferably, the internal diameter of each cylinder which contains air corresponds to half of the external diameter. The wall of the cylinders is water-tight. The hollow cylinders may be simply juxtaposed or associated with each other by contact and maintenance means. Synthetic foams may be used as a contact and maintenance means.

In order to constitute the damping zone(s) Z, the resiliently deformable elements 21 may be juxtaposed vertically over the entire surface covered by these damping zones Z.

The deformable elements Z1 may have the height of the substrate 103 in order to be able to be covered by the external surface S100, particularly if the external surface S100 is a vegetated layer 101 optionally comprising an anti-rooting device 102. Alternatively, they may have a height which is less than that of the substrate 103, corresponding, for example, to the height of the saturated portion 103*b*. The expansion effects, resulting from freezing, for example, are thus neutralized. Alternatively, in the case of a heterogeneous substrate 103 which comprises several layers, the height of the deformable elements Z1 may coincide with the thickness of one or more layers of the substrate 103. The deformable elements Z1 may be arranged directly on the segregation device 104. The damping zone(s) Z has/have a width which is preferably between 5 and 30 cm in accordance with the number thereof and the surface covered by the exchange surface. More specifically, the width of the damping zones Z is between 15 and 20 cm.

The exchange volume 100 is preferably delimited by a parapet P, which may be inscribed, for example, in the height extension of the walls of the building B. Other specific arrangements may, of course, be envisaged without being prejudicial to the present invention, such as, for example, a parapet which is positioned in a recessed state with respect to the edge of the roof. The parapet P may comprise a metal, concrete, composite or wooden cladding. Alternatively, the parapet P is the simple vertical extension of the walls of the building B. The parapet P exceeds the exchange volume 100 in order to contain it. The parapet P is preferably a cladding which is fixed to a framework from the outer side of the building B in order to be able to be readily removed or placed. It may act as a second level of safety (non-resilient) in the unlikely event of extreme freezing which would become evident as a non-homogeneous expansion of the volume of ice over the entire exchange surface.

Optionally, a vertical insulating layer 104*e* (visible in FIG. 2) may be inserted along the parapet P, over the internal portion thereof. The vertical insulating layer 104*e* may be coated with a sealed coating 104*b* and a protection layer 104*a* which may be different from the corresponding layers which are arranged horizontally between the exchange volume 100 and the building B. Preferably, the sealed coating layer 104*b* and protection layer 104*a* which are arranged vertically along the parapet P or, if necessary, the vertical insulating layer 104*e* are merged with the sealed coating layer 104*b* and protection layer 104*a* which are arranged horizontally between the exchange volume 100 and the building B in order to ensure maximum sealing.

The damping zone(s) Z may be arranged between the parapet P and, where applicable, the vertical insulating layer 104*e*. Alternatively, as illustrated in FIGS. 2 and 5, the damping zone is arranged between the substrate 103 and the vertical insulating layer 104*e*.

The parapet P, the vertical insulating layer 104*e* and the sealed coating layer 104*b* and protection layer 104*a* may be surmounted by a metal profile-member which protects them from bad weather and UV radiation which could in the long term change these elements. The passage of the circuit of the collection network 201*a* (or external network 201*b*) is preferably produced by a U-shaped bend (visible in FIG. 1*b*) rather than by transverse connections.

The exchange volume 100 may optionally comprise recesses in order to enable the passage of air discharge pipes or the installation of specific devices, such as ventilators, fans, anchoring bases for solar panels or any other device which is generally fixed to roofs. Damping zones Z may be provided at the location of these devices.

According to the invention, illustrated in FIG. 6, the external surface S100 comprises a vegetated layer 101 which is in contact with the external environment. The vegetated layer 101 may comprise various plant species of the muscoid type which are known to cover the surface on which they are arranged. Such species may comprise, for example, mosses, lichens, and any other covering species, and mixtures thereof. The preferred species are those whose height remains limited in order to restrict the maintenance operations such as cutting or mowing or in order to limit the shading brought about for in installation of photovoltaic panels or solar collectors. Robust plant species are preferably selected, in particular for their resistance to long dry periods, in order to dispense with any watering device, even if such a device may optionally be provided.

The vegetated layer 101 includes in particular mosses and any other associated species. These covering varieties which are resistant to dry periods require little maintenance. These varieties further have the characteristic of not containing stomas, in contrast to the majority of other plant species. The evapotranspiration is therefore not limited during a hot period, which contributes to cooling the surface on which the vegetated layer 101 is arranged. The evapotranspiration of the vegetated layer 101 is involved in the active modulation of the exchanges with the external environment.

The exchange volume 100 advantageously comprises in this instance an anti-rooting device 102. Such an anti-rooting device 102 may be in the form of a layer of material which is resistant to perforation, permeable to water and non-biodegradable, and which is arranged below the vegetated layer 101 in order to prevent the rooting of undesirable plant species. This is because it may be the case that varieties with deep roots grow in an uncontrolled manner and damage the thermal regulation system S or even the connected elements such as the building B or some of the constituents thereof. The anti-rooting device 102 selectively prevents the rooting of vascular plants without limiting the development of mosses and muscoid plants which do not have roots. The material used may be, for example, a geotextile which is manufactured on the basis of natural or synthetic polymers. The anti-rooting device 102 may alternatively comprise a geo-mattress or any other porous non-biodegradable element which is capable of preventing or restricting the rooting of plant species. Preferably, the anti-rooting device 102 is included in the substrate 103 at a distance from the external surface S100 between a few millimetres and 1 or 2 centimetres. Alternatively, the anti-rooting device 102 is arranged on the surface of the substrate 103. According to this arrangement, the anti-rooting device 102 nonetheless enables the development of a vegetated layer 101. The porosity thereof may in particular be sufficiently great to receive mosses.

The plant species of the muscoid type do not have a root system in order to actively extract from the soil the nutritional elements required for their sustentation and growth: their rhizoids primarily have an anchoring function. The input of nutritional elements via precipitation is generally sufficient to develop the layer of muscoid vegetation and no enrichment of the substrate is required. In contrast, the muscoid species in question benefit from substrates which are low in nutritional elements, with a neutral to acid pH. With this type of substrate, any risk of pollution of grey water is further excluded.

The thickness of the substrate 103, the anti-rooting device 102 and the vegetated layer 101 is preferably in the order of from 10 to 50 cm, more specifically in the order of from 15 to 20 cm. The height of the saturated portion 103*b* is in the order of a few centimetres, typically between 3 and 15 cm. The height of the volume of the saturated portion 103*b* may be configured to correspond to a third or a half or two thirds of the height of the substrate 103 in accordance with requirements. In the case of central vertical flows on the surface of the building with slight inclinations which are directed towards these flows, the level of the saturated portion may be provided so that it is 1-2 cm below the connection between the surface of the segregation device 104 and the parapet P in order to prevent any possibility of pressure resulting from the increase in the volume of water following freezing. In this instance, the damping zone is not absolutely necessary since the drained zone which is in contact with the parapets is capable of absorbing the expansion movements.

Optionally, the heat exchange system S according to the present invention may comprise or be connected to an installation 300 which comprises one or more sensors C1, C2 which enable one or more environmental parameters to be determined, such as the hygrometry, the temperature, the wind, the sunshine, and any other environmental parameter which may influence the state of the substrate 103, and in particular the saturated portion 103*b*. The data may be transmitted via a wired connection or a wireless connection to a central control unit 310 which comprises the means required for processing data and for determining the optimum conditions relating to thermal exchanges between the interior of the building B and the heat exchange system S. Alternatively, the environmental data may be transmitted from a weather station or a measurement centre remote from the building B. The processing of the data may include the recording thereof and the learning of an artificial intelligence program which enables the heat exchange parameters between the interior of the building B and the heat exchange system S to be determined.

The present invention further covers a method of thermal regulation comprising a step of evaporation of the water in order to cool a substrate 103 as described above. The cooling of the substrate 103 is carried out in particular as a result of the evapotranspiration of a vegetated layer 101 which is carefully selected. The plant species are in particular selected from among those which do not have any means for regulating their transpiration, and in particular which do not have stomas. Muscoid species such as mosses or lichens are thus particularly suitable.

The method according to the present invention enables an active thermal regulation as a result of the exchange volume 100 described above.

The heating and cooling system of the present invention uses in particular the inputs of latent condensation energy for the heating, the losses of latent evaporation energy for the cooling, and the thermal inertia of the water. The invention is based on monovalent methods of renewable energy and can also be combined in bivalent mode with a conventional thermal installation. It enables the interior of the building to be heated, cooled and enables the heating and cooling modes to be alternated in a synergetic manner.

REFERENCE NUMERALS USED IN THE FIGURES

100 Exchange volume
101 Vegetated layer
102 Anti-rooting device
103 Substrate
103*a* Non-saturated portion
103*b* Saturated portion
104 Segregation device
104*a* Protection layer
104*b* Sealed coating

104*c* Horizontal insulating layer
104*d* Vapor barrier
104*e* Vertical insulating layer
105 Sieve
106 Free space
107 Vertical pipe
108 Protection plate
166 Flexible framework
200 Heat diffusion device
201 Circulation pipe
201*a* Collection network
201*b* External network
201*c* Internal network
202 Circulation pump
203 Heat pump
204 Free-cooling heat exchanger
206 Circulation pump
300 Control unit
310 Control centre
B Building
C1 Sensor
C2 Sensor
E1 Vertical flow device
E2 Safety flow device
P Parapet
S Heat exchange system
S100 External surface
Z Damping zone
Z1 Deformable elements

The invention claimed is:

1. A heat exchange system which enables the thermal regulation inside a building, comprising:

a horizontal external surface superimposed on or adjacent to the building, an exchange volume arranged on the horizontal external surface, the exchange volume comprising an external surface in contact with the atmosphere, a porous substrate in the exchange volume which enables water to be retained, wherein the external surface is a vegetated layer of muscoid plants, and a plurality of collection networks in the exchange volume connected in parallel with each other by a distributor.

2. The heat exchange system of claim 1, wherein the substrate comprises a non-saturated portion and a saturated portion which is subjacent to the non-saturated portion.

3. The heat exchange system of claim 1, having a heat diffusion device comprising a circulation pump.

4. The heat exchange system of claim 3, wherein the heat diffusion device is coupled to a heat pump and/or a heat exchanger.

5. The heat exchange system of claim 1, further comprising one or more sensors which enable one or more environmental parameters to be determined.

6. The heat exchange system of claim 1, wherein the exchange volume further comprises one or more damping zones which comprise deformable elements.

7. The heat exchange system of claim 1, further comprising a parapet which is arranged on the periphery of the exchange volume and whose height exceeds that of the exchange volume in order to contain it.

8. The heat exchange system of claim 7, wherein the parapet is fixed to the building from the external periphery thereof in order to be able to be readily replaced or repaired.

9. A method of thermal regulation of a building with the external environment, wherein heat is exchanged via a heat exchange system, comprising:

a horizontal external surface superimposed on or adjacent to the building, an exchange volume arranged on the horizontal external surface, the exchange volume comprising an external surface in contact with the atmosphere, a porous substrate in the exchange volume which enables water to be retained, wherein the external surface is a vegetated layer of muscoid plants, and a plurality of collection networks in the exchange volume connected in parallel with each other by a distributor.

10. The method of claim 9, wherein the substrate comprises a non-saturated portion and a saturated portion which is subjacent to the non-saturated portion.

11. The method of claim 9, having a heat diffusion device comprising a circulation pump, the heat diffusion device being coupled to a heat pump and/or a heat exchanger.

12. The method of claim 9, comprising reading one or more environmental parameters from one or more sensors and controlling the heat exchange system based on said environmental parameters.

13. The heat exchange system of claim 1, wherein the exchange volume comprises an anti-rooting device.

14. The method of claim 9, wherein the exchange volume comprises an anti-rooting device.

15. A heat exchange system which enables the thermal regulation inside a building, comprising:

a horizontal external surface superimposed on or adjacent to the building, an exchange volume arranged on the horizontal external surface, the exchange volume comprising an external surface in contact with the atmosphere, wherein the external surface is a vegetated layer of muscoid plants, one or more damping zones in the exchange volume, the damping zones having resiliently deformable elements comprising hollow cylinders, a porous substrate in the exchange volume which enables water to be retained.

16. The heat exchange system of claim 15, the damping zones extending over an entire periphery of the exchange volume.

17. The heat exchange system of claim 15, the hollow cylinders having an external diameter and an internal diameter corresponding to a third to two thirds of the external diameter, which contains air.

18. The heat exchange system of claim 15, wherein the exchange volume comprises an anti- rooting device.

19. The heat exchange system of claim 15, having a heat diffusion device comprising a circulation pump.

* * * * *